US007387156B2

(12) United States Patent
Drummond et al.

(10) Patent No.: US 7,387,156 B2
(45) Date of Patent: Jun. 17, 2008

(54) PERFORATING SAFETY SYSTEM

(75) Inventors: Gavin H. Drummond, Aberdeen (GB); Flint George, Flower Mound, TX (US); Ryan A. Harrison, Carrollton, TX (US); John Hales, Frisco, TX (US); Justin Mason, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 184 days.

(21) Appl. No.: 11/272,602

(22) Filed: Nov. 14, 2005

(65) Prior Publication Data

US 2007/0107893 A1 May 17, 2007

(51) Int. Cl.
*E21B 43/11* (2006.01)

(52) U.S. Cl. ..... 166/55.1; 175/4.54

(58) Field of Classification Search ..... 166/297, 166/298, 55.1; 175/4.54
See application file for complete search history.

(56) References Cited

U.S. PATENT DOCUMENTS

| | | | |
|---|---|---|---|
| 4,172,421 | A | 10/1979 | Regalbuto |
| 4,217,828 | A | 8/1980 | Pelousse |
| 4,314,614 | A | 2/1982 | McPhee et al. |
| 4,319,526 | A | 3/1982 | DerMott |
| 4,635,734 | A | 1/1987 | Donovan |
| 4,730,559 | A | 3/1988 | Brightman |
| 4,747,201 | A | 5/1988 | Donovan et al. |
| 4,765,245 | A | 8/1988 | Berube et al. |
| 5,070,788 | A | 12/1991 | Carisella et al. |
| 5,115,865 | A | 5/1992 | Carisella et al. |
| 5,159,150 | A | 10/1992 | Wardecki |
| 5,206,457 | A | 4/1993 | Pascal et al. |
| 5,223,665 | A | 6/1993 | Burleson et al. |
| 5,275,101 | A | 1/1994 | Chemiere et al. |
| 5,277,262 | A | 1/1994 | Huber et al. |
| 5,346,014 | A | 9/1994 | Ross |
| 5,375,525 | A | 12/1994 | Greenslade et al. |
| 5,392,860 | A | 2/1995 | Ross |
| 5,889,227 | A | 3/1999 | Wardecki |

(Continued)

FOREIGN PATENT DOCUMENTS

| | | |
|---|---|---|
| EP | 23179 | 1/1981 |

(Continued)

OTHER PUBLICATIONS

Search Report for United Kingdom application No. GB0623406.6.

*Primary Examiner*—William P Neuder
(74) *Attorney, Agent, or Firm*—Marlin R. Smith

(57) ABSTRACT

A perforating safety system. A perforating safety system includes a detonation transfer interrupter with a device which decreases an axial separation between detonation transfer components after installation of the interrupter in the well. Another perforating safety system includes a perforating gun and firing head installed together in the well, and an interrupter having a device which increases a separation between detonation transfer components in the well to thereby prevent transfer of detonation from the firing head to the perforating gun. Yet another perforating safety system includes a firing head positioned at a distal end of a perforating assembly when installed in the well, and an interrupter having a device which decreases a separation between detonation transfer components after installation of the interrupter in the well.

17 Claims, 6 Drawing Sheets

U.S. PATENT DOCUMENTS

| | | | | |
|---|---|---|---|---|
| 6,053,111 | A | 4/2000 | Motley | |
| 6,095,258 | A | 8/2000 | Reese et al. | |
| 6,182,750 | B1 * | 2/2001 | Edwards et al. | 166/55.1 |
| 6,311,622 | B1 | 11/2001 | Adimari et al. | |
| 6,336,407 | B1 | 1/2002 | Adimari et al. | |
| 6,578,488 | B2 | 6/2003 | Strauss et al. | |
| 2004/0118562 | A1 * | 6/2004 | George | 166/297 |
| 2004/0216632 | A1 * | 11/2004 | Finsterwald | 102/310 |

FOREIGN PATENT DOCUMENTS

| | | |
|---|---|---|
| EP | 75496 | 3/1983 |
| EP | 411996 | 2/1991 |
| EP | 463974 | 1/1992 |
| EP | 499701 | 8/1992 |
| EP | 724132 | 7/1996 |
| EP | 781975 | 7/1997 |
| GB | 2385343 | 8/2003 |
| GB | 2395969 | 6/2004 |
| WO | WO 96/35095 | 11/1996 |

* cited by examiner

PERFORATING SAFETY SYSTEM

BACKGROUND

The present invention relates generally to equipment and procedures used in conjunction with subterranean wells and, in an embodiment described herein, more particularly provides a safety system for use in perforating operations.

Perforating typically involves use of explosive shaped charges in a perforating gun to form perforations or openings through casing cemented in a well. Detonation of the shaped charges is initiated by a device known as a firing head. The firing head may be operated mechanically, electrically, by application of pressure, via various forms of telemetry, etc.

For safety reasons, it would be desirable to isolate the firing head from the perforating gun prior to installing a perforating assembly in a well. Preferably, the firing head would also be isolated from the perforating gun while the perforating assembly is being installed and aligned with a zone to be perforated. In this manner, detonation of the shaped charges in the perforating gun could be avoided, even though the firing head might accidentally be operated, prior to the time when it is desired to perforate the zone.

Furthermore, it would be beneficial to retrieve the perforating gun from the well, without also retrieving the firing head at the same time, in the event that the firing head malfunctions. In this manner, accidental detonation of the shaped charges during retrieval of the perforating gun can be avoided.

SUMMARY

In carrying out the principles of the present invention, a perforating safety system is provided which solves at least one problem in the art. One example is described below in which the perforating safety system includes a detonation transfer interrupter for preventing transfer of detonation between a firing head and a perforating gun. Another example is described below in which the detonation transfer interrupter permits the firing head to be detached from the perforating gun in the well.

In one aspect of the invention, a perforating safety system for use in a well is provided. The system includes a detonation transfer interrupter. The interrupter includes a device which decreases an axial separation between detonation transfer components after installation of the interrupter in the well.

In another aspect of the invention, a perforating safety system is provided which includes a perforating assembly with a perforating gun, a firing head and a detonation transfer interrupter. The perforating gun and firing head are installed together in the well. The interrupter includes a device which is capable of increasing a separation between detonation transfer components in the well to thereby prevent transfer of detonation from the firing head to the perforating gun.

In yet another aspect of the invention, a perforating safety system is provided in which the firing head is positioned at a distal end of the perforating assembly when the perforating assembly is installed in the well. The interrupter includes a device which decreases a separation between detonation transfer components after installation of the interrupter in the well.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
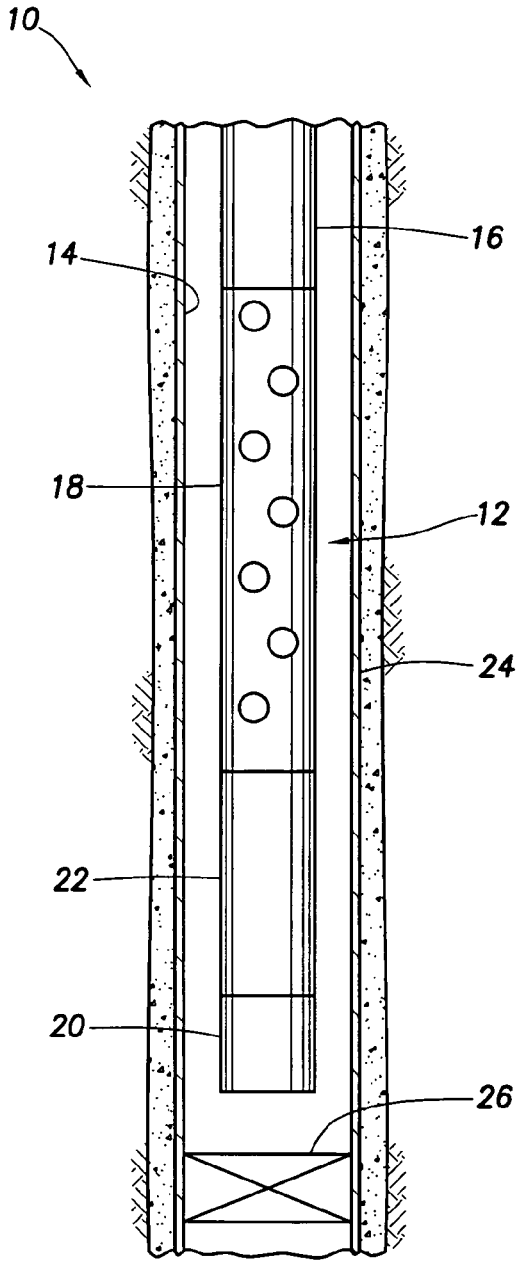
FIG. 1 is a schematic partially cross-sectional view of a perforating safety system embodying principles of the present invention.

Representatively illustrated in FIG. 1 is a system 10 which embodies principles of the present invention. As depicted in FIG. 1, a perforating assembly 12 has been installed in a wellbore 14 of a well. A tubular string 16, such as a production tubing string, is used to convey the perforating assembly 12 into the well.

The perforating assembly 12 includes a perforating gun 18, a firing head 20 and a detonation transfer interrupter 22. The perforating gun 18 may be of conventional design and may include one or more shaped charges (not shown) which are detonated in order to perforate casing 24 lining the wellbore 14. The perforating gun 18 may also include other elements, such as detonating cord, boosters, and other types of detonation transfer components. The perforating assembly 12 may include multiple perforating guns 18.

The firing head 20 may also be of conventional design. Any method of actuating the firing head 20 may be used, such as application of a predetermined pressure, transmission of a pressure, electrical or telemetry signal, mechanical actuation, etc. In the system 10 as depicted in FIG. 1, preferably the firing head 20 is pressure actuated.

Figure 2:
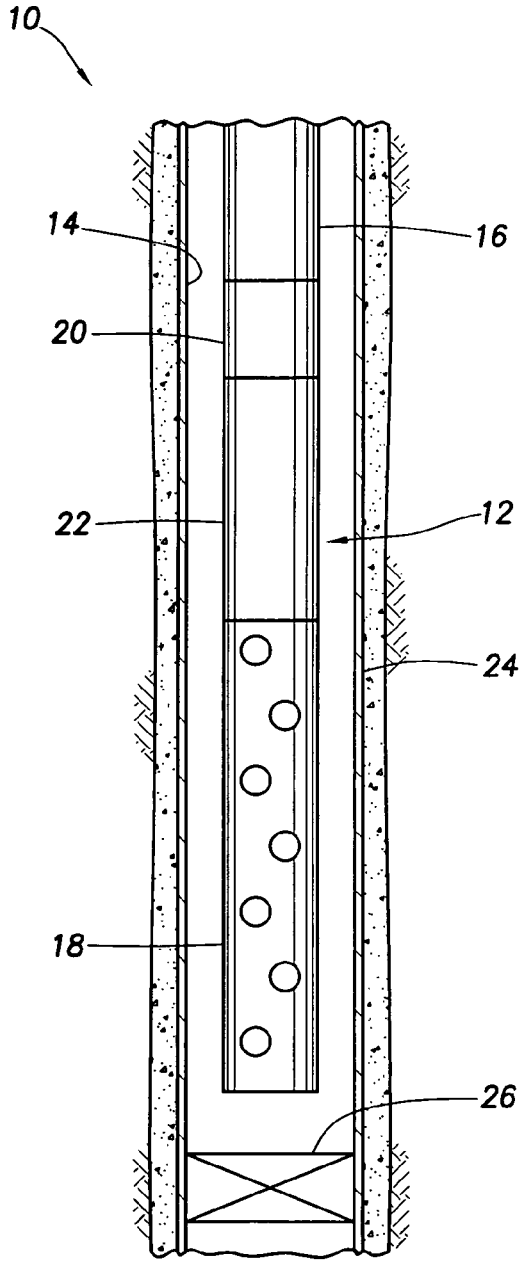
FIG. 2 is a schematic partially cross-sectional view of an alternate configuration of the system of FIG. 1.

As shown in FIG. 1, the firing head 20 is positioned at a distal end of the perforating assembly 12, that is, at an end of the perforating assembly which is farthest from the surface along the wellbore 14. However, the firing head 20 could be otherwise positioned, and an example of another positioning of the firing head is illustrated in FIG. 2.

The detonation transfer interrupter 22 is preferably positioned between the firing head 20 and the perforating gun 18. The interrupter 22 is used to prevent transfer of detonation from the firing head 20 to the perforating gun 18. In addition, the interrupter 22 may be used to detach the firing head 20 from the remainder of the perforating assembly 12, so that the perforating gun 18 can be retrieved from the well separate from the firing head, for example, in the event of a malfunction of the firing head or perforating gun.

The interrupter 22 initially maintains a sufficient separation between detonation transfer components to prevent transfer of detonation between the components. After installation of the perforating assembly 12 in the well, the interrupter 22 permits the separation to be decreased, so that detonation can be transferred between the components.

Various methods are described below for actuating the interrupter 22 to decrease the separation between the detonation transfer components. In one example, the perforating assembly 12 is lowered until it contacts a bridge plug 26 or other obstruction (such as a casing shoe, sump packer, etc.), and then weight is set down on the tubular string 16 to thereby apply a compressive force to the interrupter 22.

Referring additionally now to FIG. 2, an alternate configuration of the system 10 is representatively illustrated. In this configuration, the firing head 20 is positioned above the perforating gun 18, and alternate methods of actuating the firing head (such as by dropping a weighted bar through the tubular string 16, applying pressure to the tubular string without also applying pressure to the wellbore about the perforating gun 18, etc.) may be used.

Note that, with the interrupter 22 positioned between the firing head 20 and the perforating gun 18 in the configuration of FIG. 2, the interrupter can detach the firing head from the perforating gun and thereby enable the firing head to be retrieved from the well prior to retrieving the perforating gun from the well. Thus, the configuration of FIG. 2 demonstrates that a variety of arrangements of the elements described herein may be used, and the invention is not limited to the specific details of the configurations of the system 10 illustrated in the drawings.

Figure 3:
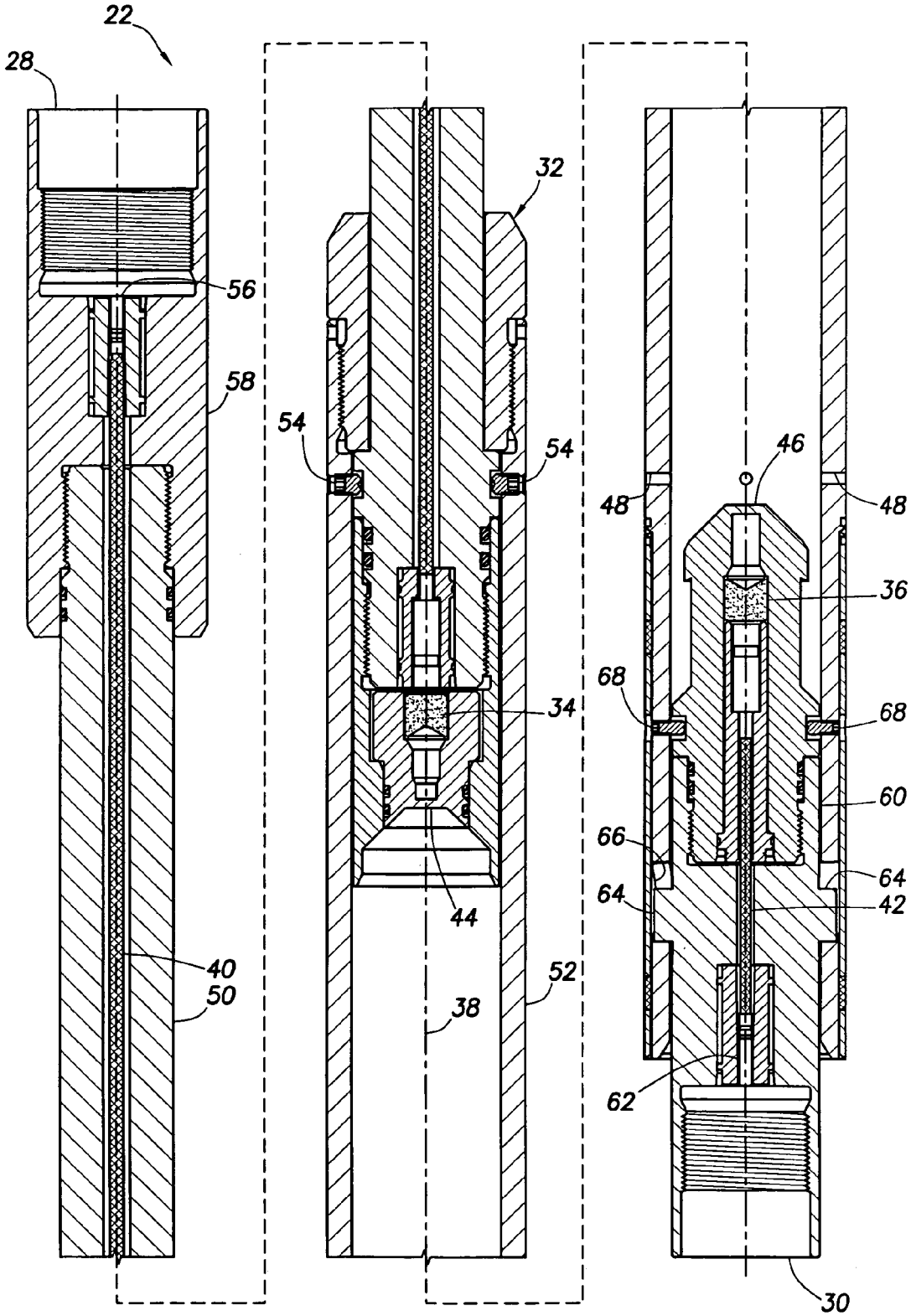
FIG. 3 is a cross-sectional view of a detonation transfer interrupter which may be used in the system of FIG. 1, the interrupter being shown in an installation configuration.

Referring additionally now to FIG. 3, an enlarged scale cross-sectional view of the detonation transfer interrupter 22 is representatively illustrated. As shown in FIG. 3, the interrupter 22 is in an installation configuration in which it is conveyed into the well as part of the perforating assembly 12 in the system 10. Of course, the interrupter 22 can be used in other systems in keeping with the principles of the invention.

The interrupter 22 is depicted as it would be oriented in the configuration of the system 10 shown in FIG. 10 (i.e., with the perforating gun 18 attached at an upper end 28 of the interrupter, and the firing head 20 attached at a lower end 30 of the interrupter). When used in the configuration of the system 10 as shown in FIG. 2, or in other system configurations, the interrupter 22 may be differently arranged and/or otherwise modified as appropriate.

As depicted in FIG. 3, the interrupter 22 includes a telescoping device 32 for selectively increasing and decreasing an axial separation between two detonation transfer components 34, 36. The detonation transfer components 34, 36 are aligned along a longitudinal axis 38 of the device 32, but are initially separated by a distance sufficient to prevent transfer of detonation between the components.

The detonation transfer components 34, 36 are preferably of the type known to those skilled in the art as bidirectional boosters. Such boosters are used to transfer detonation both to and from other explosive components, such as detonating cords 40, 42 in the interrupter 22.

At least the lower detonation transfer component 36 is preferably a specialized explosive which is shaped (similar to the manner in which explosive shaped charges are shaped to form a penetrating jet) so that it is capable of penetrating metal pressure barriers 44, 46 which isolate the various explosive components from well pressure admitted into the device 32 via openings 48. In other embodiments (such as the embodiment illustrated in FIG. 7), such specialized shaped explosives may not be used.

The device 32 includes a mandrel assembly 50 reciprocably received in a generally tubular housing assembly 52. In the illustrated installation configuration, the mandrel assembly 50 is extended a maximum distance outward from the housing assembly 52, and is maintained in this position by shear screws 54.

It will be appreciated that, if a sufficient compressive force is applied to the device 32 so that the screws 54 are sheared, the mandrel assembly 50 will be permitted to displace further into the housing assembly 52. Such inward displacement of the mandrel assembly 50 will decrease the axial separation between the detonation transfer components 34, 36.

The detonating cord 40 extends through the mandrel assembly 50 from the detonation transfer component 34 to another detonation transfer component 56 in an upper connector assembly 58. This detonation transfer component 56 is another type of booster used to transfer detonation to the perforating gun 18 attached at the upper end 28 of the interrupter 22.

The detonating cord 42 extends through a lower connector assembly 60 received in the housing assembly 52. The detonating cord 42 is used to transfer detonation from another detonation transfer component 62 to the component 36.

The lower connector assembly 60 is attached at an upper end of the firing head 20. When the firing head 20 is actuated, detonation from the firing head is transferred to the component 62, then to the cord 42, and then to the component 36.

The lower connector assembly 60 is retained in the housing assembly 52 by means of lugs 64 received in a J-slot or ratchet profile 66. In the installation configuration depicted in FIG. 3, the profile 66 prevents the lugs 64 and the remainder of the connector assembly 60 from being detached from the housing assembly 52.

Shear screws 68 maintain the lugs 64 engaged in the profile 66 as shown in FIG. 3. However, when sufficient compressive force is applied to the interrupter 22, the screws will shear and permit the lugs 64 to displace in the profile 66 to another position in which the lower connector assembly 60 will be able to separate from the housing assembly 52.

Preferably, the shear screws 68 are designed to shear at a somewhat lesser compressive force than the shear screws 54. In this manner, the lower connector assembly 60 is effectively detached from the housing assembly 52 prior to the mandrel assembly 50 displacing into the housing assembly.

Figure 4:
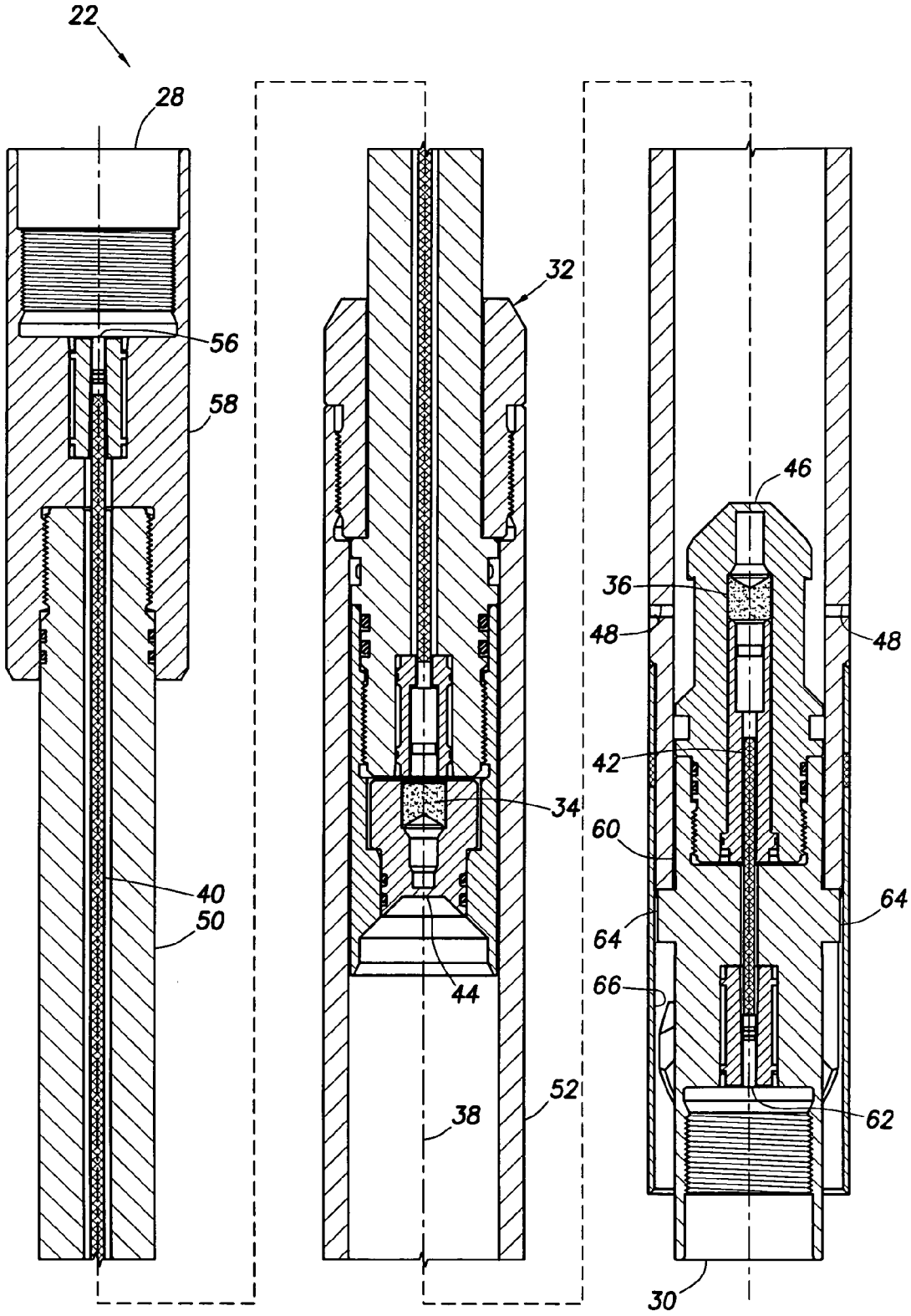
FIG. 4 is a cross-sectional view of the interrupter, shown in a firing head disconnect configuration.

Referring additionally now to FIG. 4, the interrupter 22 is representatively illustrated in a configuration in which sufficient compressive force has been applied to the interrupter to shear the screws 68. Note that the lower connector assembly 60 has displaced somewhat into the housing assembly 52, and the lugs 64 are now in a portion of the profile 66 which will permit the lower connector assembly to be separated from the housing assembly.

In the system 10, compressive force is applied to the interrupter 22 by contacting the bridge plug 26 (or another obstruction in the wellbore 14) and setting down weight on the tubular string 16 from the surface. Other methods of applying a compressive force, and other means of detaching the lower connector 60 from the housing assembly 52 may be used in keeping with the principles of the invention.

Figure 5:
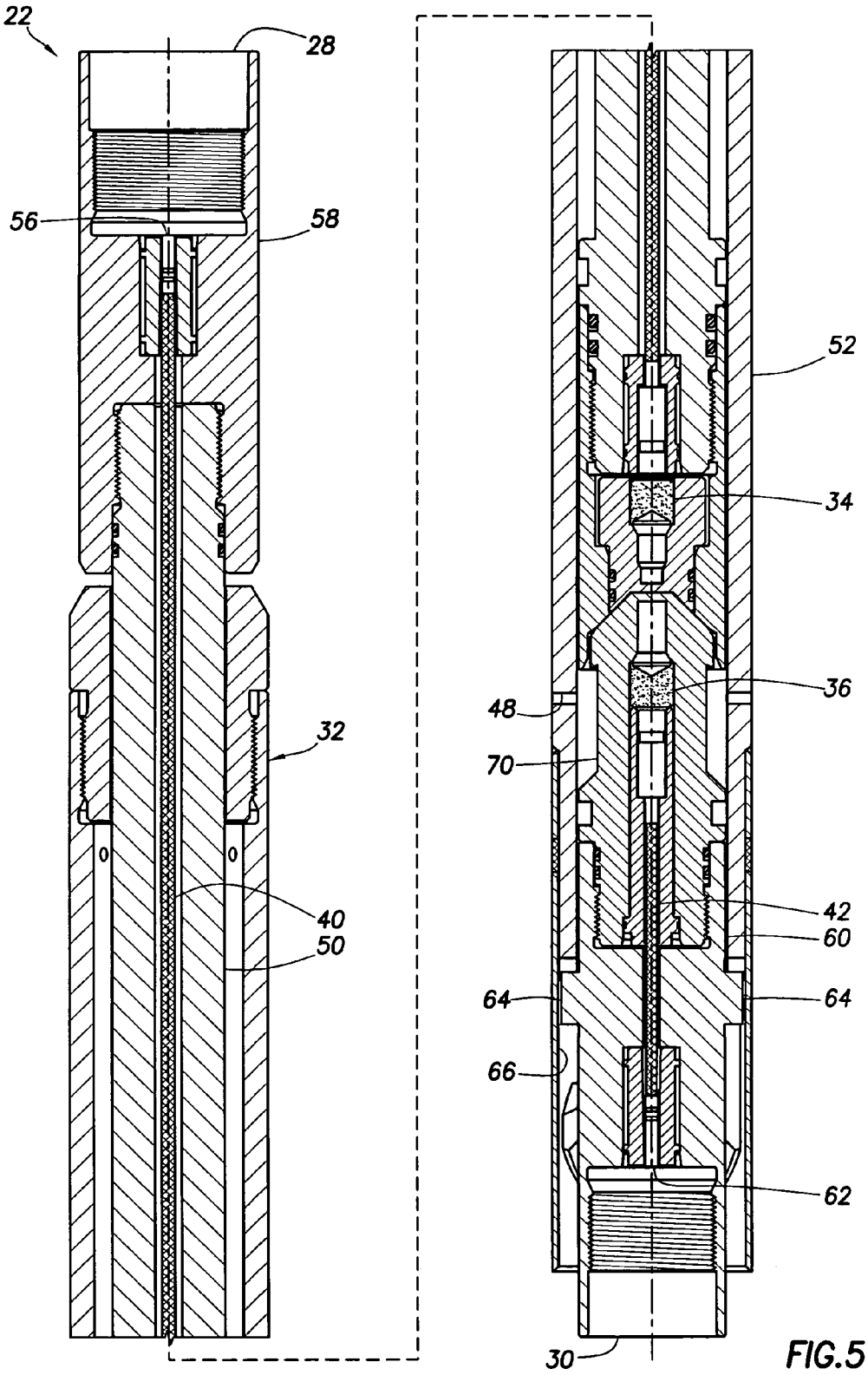
FIG. 5 is a cross-sectional view of the interrupter, shown in a detonation transfer configuration.

Referring additionally now to FIG. 5, the interrupter 22 is representatively illustrated in a configuration in which additional compressive force has been applied to the interrupter to shear the screws 54. In addition, the mandrel assembly 50 has been displaced into the housing assembly 52, thereby decreasing the axial separation between the detonation transfer components 34, 36.

The firing head 20 can now be actuated, thereby initiating detonation and transferring the detonation to the component 62, the cord 42, the component 36, the component 34, the cord 40, the component 56, and then to the perforating gun 18. Detonation transfer between the components 34, 36 is achieved due to the decreased axial separation between these components.

In case of a misfire of the firing head 20, or another malfunction, the components 34, 36 can again be axially separated a sufficient distance to prevent detonation transfer. This is accomplished by picking up on the tubular string 16 at the surface and thereby displacing the mandrel assembly 50 out from the housing assembly 52. This will increase the axial separation between the components 34, 36 and prevent detonation transfer between the components, so that the perforating gun 18 can be safely retrieved from the well.

When the housing assembly 52 is picked up during retrieval of the perforating gun 18, the lower connector assembly 60 will not also be picked up. This is due to the lugs 64 being positioned in the profile 66 such that the lower connector assembly 60 is detached from the housing assembly 52.

Thus, the lower connector assembly 60 and the firing head 20 will remain in the well when the perforating gun 18 and the remainder of the interrupter 22 are retrieved from the well. A substantial weight may be attached below the firing head 20, so that a lack of this weight during retrieval of the perforating gun 18 will provide confirmation that the firing head has been detached from the perforating gun. The lower connector assembly 60 and firing head 20 can be retrieved later, and a fishing neck 70 is provided on the lower connector assembly for this purpose.

In the system 10 as depicted in FIG. 2, the interrupter 22 is connected below the firing head 20. Thus, in the event of a misfire or other malfunction, the firing head 20 can be retrieved from the well with the tubular string 16, and then the perforating gun 18 (attached below the lower connector assembly 60) can be retrieved.

Figure 6:
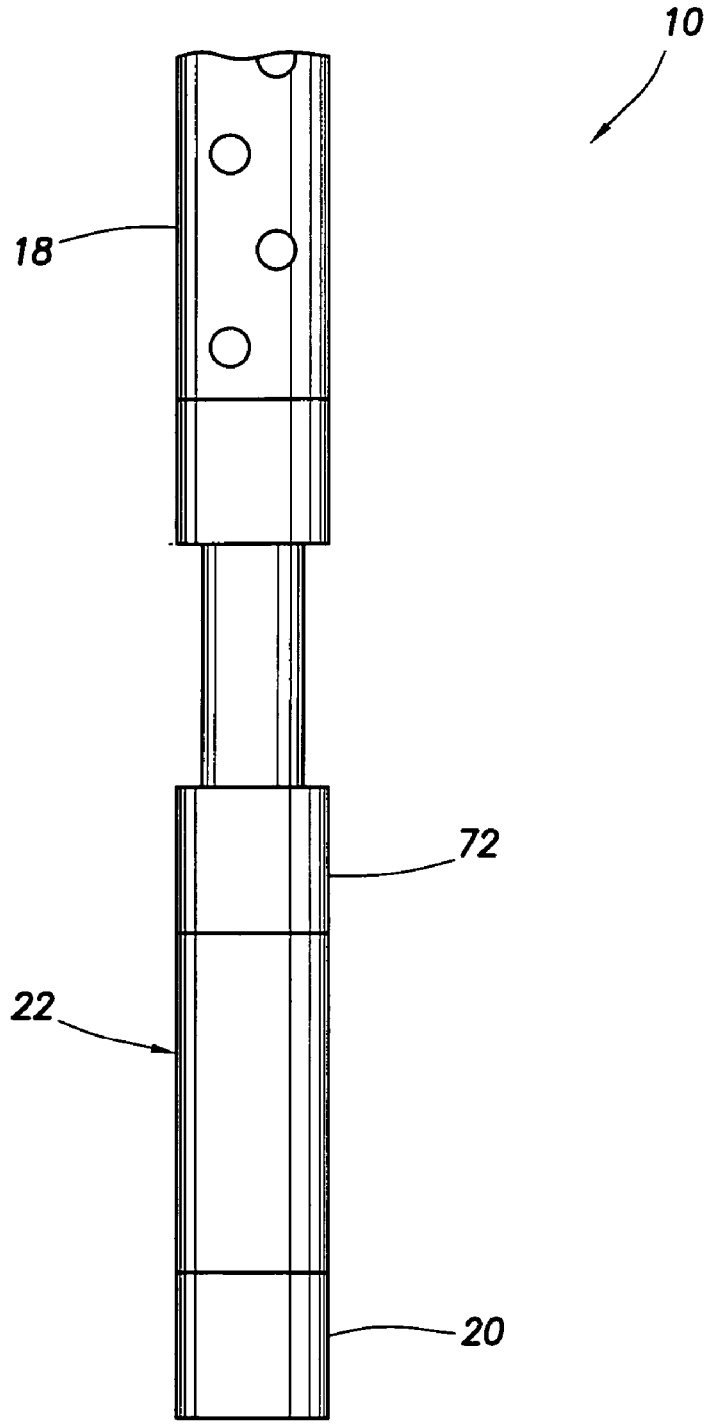
FIG. 6 is a schematic elevational view of an alternate configuration of the detonation transfer interrupter.

Referring additionally now to FIG. 6, the system 10 is schematically illustrated in another alternate configuration. Only the perforating assembly 12 (including the perforating gun 18, firing head 20 and interrupter 22) is depicted in FIG. 6.

Instead of the device 32 described above which is actuated by compressive force applied to the interrupter 22, an alternate device 72 is used in the configuration of FIG. 6. The device 72 still operates to decrease an axial separation between the detonation transfer components 34, 36, but does so in a different manner.

For example, the device 72 could include an electric motor which is supplied with electrical power (such as from a battery) to displace the mandrel assembly 50 into the housing assembly 52. The device 72 could also displace the mandrel assembly 50 out from the housing assembly 52 to increase the axial separation between the detonation transfer components 34, 36 to prevent detonation transfer, for example, to allow safe retrieval of the perforating assembly 12.

The device 72 could be actuated using telemetry (for example, electrical, acoustic, pressure pulse, electromagnetic, or other type of telemetry) from the earth's surface or another a remote location. The device 72 could be operated in response to a pressure variation, an electrical signal, a temperature variation, a magnetic variation, application of a biasing force, application of a predetermined pressure, or any other type of stimulus or combination of stimuli.

The device 72 could include a piston which displaces in response to pressure applied to the piston in the well to thereby change (decrease and/or increase) the axial separation between the detonation transfer components 34, 36. The device 72 could include magnetic elements (such as permanent magnets, temporary magnets, electromagnets, magnetostrictive material, etc.) to change the axial separation between the detonation transfer components 34, 36. The device 72 could include energy storing elements (such as a spring, accumulator, etc.) and associated mechanism (such as a ratchet, piston and cylinder, etc.) to change the axial separation between the detonation transfer components 34, 36.

The device 72 could include a material which responds to a parameter in the well (such as temperature, pressure, presence of a certain fluid, etc.) to change the axial separation between the detonation transfer components 34, 36. For example, a shape memory alloy which changes shape when exposed to a predetermined temperature could be used to displace the component 36 relative to the component 34. The predetermined temperature could be supplied by the environment in the well, or an electrical heater could be used to selectively heat the shape memory alloy, thereby allowing enhanced control over both decreasing and increasing of the axial separation between the detonation transfer components 34, 36.

Therefore, it will be appreciated that a large variety of different methods may be used to operate the interrupter 22. Many of these different methods do not require that a compressive force be applied to the interrupter 22.

It should be clearly understood that the invention is not limited to any of the specific methods described herein. Instead, the invention can be incorporated into many different configurations of the interrupter 22.

Figure 7:
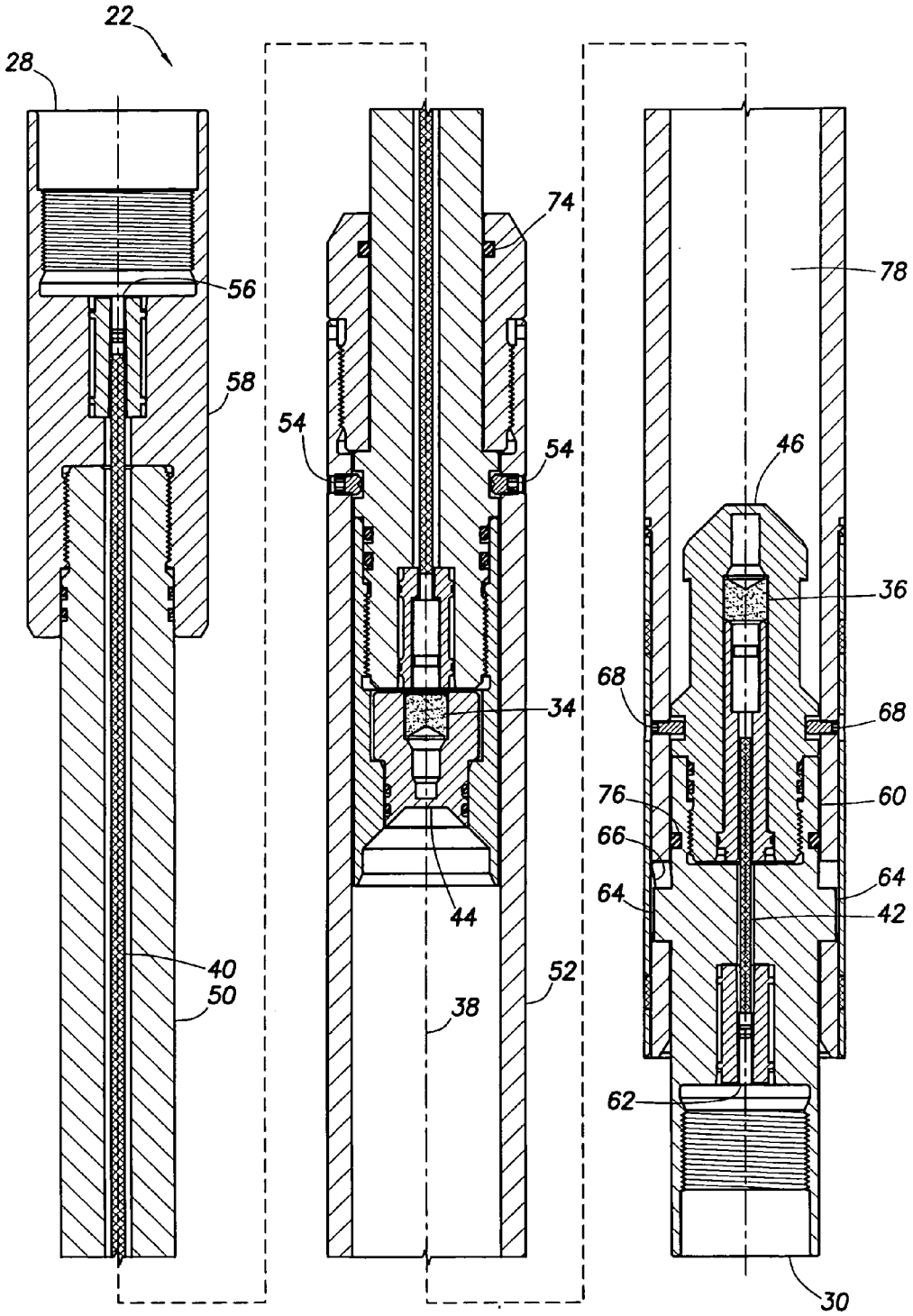
FIG. 7 is a cross-sectional view of another alternate configuration of the detonation transfer interrupter.

One of these different configurations is representatively illustrated in FIG. 7. This is a pressure operated version of the detonation transfer interrupter 22.

Note that the configuration illustrated in FIG. 7 is very similar to the configuration illustrated in FIGS. 3-5. Significant changes include elimination of the openings 48 in the housing assembly 52 and provision of seals 74, 76 to isolate an internal chamber 78 of the housing assembly from well pressure.

The seal 74 seals between the housing assembly 52 and the mandrel assembly 50. The seal 76 seals between the housing assembly 52 and the lower connector assembly 60. Preferably, atmospheric pressure or another relatively low pressure is contained in the chamber 78 between the seals 74, 76.

The seals 74, 76 effectively make the mandrel assembly 50 and lower connector assembly 60 into pistons which are biased inward relative to the housing assembly 52 by well pressure. When a predetermined pressure is applied to the interrupter 22 in the well, the screws 68 will shear and the lugs 64 will displace in the profile 66 as described above to permit the lower connector assembly 60 to be detached from the housing assembly 52.

When an increased predetermined pressure is applied to the interrupter 22 in the well, the screws 54 will shear and the mandrel assembly 50 will displace into the housing assembly 52, thereby decreasing the axial separation between the detonation transfer components 34, 36. A dampener (not shown) could be provided to slow the displacement of the mandrel assembly 50 relative to the housing assembly 52.

In the event of a misfire or other malfunction, the chamber 78 could be vented to the wellbore 14 (for example, using an electrically or mechanically operated valve, not shown) to permit the lower connector assembly 60 to be withdrawn from within the housing assembly 52 and/or to permit the mandrel assembly 50 to displace outward from the housing assembly. This will increase the axial separation between the detonation transfer components 34, 36 to permit safe retrieval of the perforating assembly 12 from the well.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A perforating safety system for use in a subterranean well, the system comprising:

a detonation transfer interrupter including a device which decreases an axial separation between detonation transfer components after installation of the interrupter in the well, and wherein the interrupter detaches the firing head from the perforating gun in the well.

2. The system of claim 1, wherein the interrupter is positioned between a perforating gun and a firing head.

3. The system of claim 2, wherein the perforating gun, firing head and interrupter are installed together in the well as portions of a perforating assembly.

4. The system of claim 3, wherein the firing head is positioned at a distal end of the perforating assembly when the perforating assembly is installed in the well.

5. The system of claim 1, wherein the device decreases the axial separation in response to application of a compressive force to the interrupter in the well.

6. The system of claim 1, wherein the device decreases the axial separation in response to at least one of: a telemetry signal, a pressure variation, an electrical signal, a temperature variation, a magnetic variation, application of a biasing force, and application of a predetermined pressure.

7. A perforating safety system for use in a subterranean well, the system comprising:

a perforating assembly including a perforating gun, a firing head and a detonation transfer interrupter, the perforating gun and firing head being installed together in the well, and the interrupter including a device which selectively increases a separation between detonation transfer components in the well to thereby prevent transfer of detonation from the firing head to the perforating gun.

8. The system of claim 7, wherein the device is further capable of decreasing the separation between the detonation transfer components in the well.

9. The system of claim 8, wherein the separation between the detonation transfer components is axial separation.

10. The system of claim 7, wherein the interrupter detaches the firing head from the perforating gun in the well.

11. The system of claim 7, wherein the firing head is positioned at a distal end of the perforating assembly when the perforating assembly is installed in the well.

12. The system of claim 7, wherein the device decreases the separation in response to application of a compressive force to the interrupter in the well.

13. The system of claim 7, wherein the device increases the separation in response to at least one of: a telemetry signal, a pressure variation, an electrical signal, a temperature variation, a magnetic variation, application of a biasing force, and application of a predetermined pressure.

14. The system of claim 7, wherein the device decreases the separation in response to at least one of: a telemetry signal, a pressure variation, an electrical signal, a temperature variation, a magnetic variation, application of a biasing force, and application of a predetermined pressure.

15. A perforating safety system for use in a subterranean well, the system comprising:

a perforating assembly including a perforating gun, a firing head and a detonation transfer interrupter, the firing head being positioned at a distal end of the perforating assembly when the perforating assembly is installed in the well, and the interrupter including a device which decreases a separation between detonation transfer components after installation of the interrupter in the well, and wherein the device decreases the separation in response to application of weight to the interrupter in the well.

16. The system of claim 15, wherein the interrupter detaches the firing head from the perforating gun in the well.

17. The system of claim 15, wherein the device is capable of increasing the separation in the well.

* * * * *